US012083646B2

(12) United States Patent
Shibue et al.

(10) Patent No.: US 12,083,646 B2
(45) Date of Patent: Sep. 10, 2024

(54) POLISHING APPARATUS, POLISHING METHOD AND METHOD FOR OUTPUTTING VISUALIZATION INFORMATION OF FILM THICKNESS DISTRIBUTION ON SUBSTRATE

(71) Applicant: EBARA CORPORATION, Tokyo (JP)

(72) Inventors: Hiroaki Shibue, Tokyo (JP); Taro Takahashi, Tokyo (JP); Toshiki Miyakawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/573,134

(22) Filed: Jan. 11, 2022

(65) Prior Publication Data

US 2022/0219283 A1 Jul. 14, 2022

(30) Foreign Application Priority Data

Jan. 14, 2021 (JP) ..... 2021-003921

(51) Int. Cl.
*B24B 37/013* (2012.01)
*B24B 37/04* (2012.01)

(52) U.S. Cl.
CPC ..... *B24B 37/013* (2013.01); *B24B 37/042* (2013.01)

(58) Field of Classification Search
CPC ... B24B 37/005; B24B 37/013; B24B 37/042; B24B 37/00; B24B 37/04; B24B 37/11; B24B 37/07; B24B 37/10; B24B 37/105; B24B 7/228; B24B 49/02; B24B 49/04; B24B 49/10; B24B 49/12
USPC ..... 451/5
See application file for complete search history.

(56) References Cited

U.S. PATENT DOCUMENTS 5,823,853 A * 10/1998 Bartels ..... B24B 49/04 451/6
5,838,447 A 11/1998 Hiyama et al.
8,246,417 B2 * 8/2012 Kobayashi ..... B24B 37/04 451/6
2002/0173084 A1 * 11/2002 Ohkawa ..... H01L 21/7624 438/149
2004/0214509 A1 10/2004 Elledge
(Continued)

FOREIGN PATENT DOCUMENTS

CN 1341277 A * 3/2002
CN 114695167 A * 7/2022
(Continued)

OTHER PUBLICATIONS

JP-2003347258-A espacenet (Year: 2023).*
CN-1341277-A espacenet (Year: 2023).*
CN-114695167-A espacenet (Year: 2023).*

*Primary Examiner* — Brian D Keller
*Assistant Examiner* — Tim Brady
(74) *Attorney, Agent, or Firm* — BakerHostetler

(57) ABSTRACT

A polishing apparatus capable of acquiring accurate film thickness distribution information is disclosed. The polishing apparatus includes a polishing table, a plurality of film thickness sensors, and a controller. The controller analyzes film thickness distribution information of a substrate while identifying a notch position of the substrate based on the measured film thickness information, and outputs visualization information of the film thickness distribution with the notch position as a reference position.

6 Claims, 11 Drawing Sheets

(56) References Cited

U.S. PATENT DOCUMENTS

| | | | | |
|---|---|---|---|---|
| 2010/0029177 | A1 | 2/2010 | Kobayashi et al. | |
| 2012/0164917 | A1* | 6/2012 | Kobata | B24B 37/205 451/6 |
| 2014/0148008 | A1 | 5/2014 | Wu et al. | |
| 2015/0017887 | A1* | 1/2015 | Kobayashi | B24B 37/013 451/73 |
| 2015/0099424 | A1* | 4/2015 | Takahashi | B24B 37/013 451/5 |
| 2018/0264619 | A1 | 9/2018 | Yoshida | |
| 2019/0118333 | A1* | 4/2019 | Yagi | B24B 37/013 |
| 2019/0134774 | A1* | 5/2019 | Yagi | B24B 37/32 |
| 2019/0240799 | A1* | 8/2019 | Takeda | B24B 49/04 |
| 2019/0351526 | A1* | 11/2019 | Umemoto | B24B 37/27 |
| 2020/0198094 | A1* | 6/2020 | Yagi | B24B 37/20 |
| 2020/0269385 | A1* | 8/2020 | Kobata | B24B 57/02 |
| 2020/0406422 | A1* | 12/2020 | Watanabe | H01L 21/30625 |
| 2021/0101250 | A1* | 4/2021 | Watanabe | B24B 49/12 |
| 2021/0114164 | A1* | 4/2021 | Kabasawa | B24B 37/013 |
| 2021/0170542 | A1* | 6/2021 | Sakashita | H01L 21/3212 |
| 2021/0170544 | A1* | 6/2021 | Yagi | B24B 49/12 |
| 2022/0072590 | A1* | 3/2022 | Takahashi | B08B 3/02 |
| 2022/0288742 | A1* | 9/2022 | Takahashi | B24B 37/013 |

FOREIGN PATENT DOCUMENTS

| | | | | |
|---|---|---|---|---|
| JP | H09-085611 | A | | 3/1997 |
| JP | 2002-124497 | A | | 4/2002 |
| JP | 2003347258 | A | * | 12/2003 |
| JP | 2006-524588 | A | | 11/2006 |
| JP | 2016-078155 | A | | 5/2016 |
| JP | 2017-064801 | A | | 4/2017 |
| JP | 2019-084614 | A | | 6/2019 |
| JP | 2019-198938 | A | | 11/2019 |
| WO | WO 2008/032753 | A1 | | 3/2008 |

* cited by examiner

POLISHING APPARATUS, POLISHING METHOD AND METHOD FOR OUTPUTTING VISUALIZATION INFORMATION OF FILM THICKNESS DISTRIBUTION ON SUBSTRATE

CROSS REFERENCE TO RELATED APPLICATION

This document claims priority to Japanese Patent Application No. 2021-003921 filed Jan. 14, 2021, the entire contents of which are hereby incorporated by reference.

BACKGROUND

Chemical mechanical polishing (CMP) is known as a technology in a manufacturing process of semiconductor devices. A polishing apparatus for CMP includes a polishing table that supports a polishing pad and a polishing head for holding a wafer.

When polishing the wafer using such polishing apparatus, the wafer is held by the polishing head and pressed against a polishing surface of the polishing pad at a predetermined pressure. At this time, the wafer slides against the polishing surface by moving the polishing table and the polishing head relative to each other, and a surface of the wafer is polished.

Further, a signal corresponding to a film thickness of the wafer is detected by a film thickness sensor to acquire a film thickness distribution of the wafer. Based on the film thickness distribution of the wafer, an end point of polishing is determined and the pressure of a plurality of air bags installed concentrically in the polishing head is controlled. The film thickness sensor rotates with the polishing table, and the polishing head holding the wafer also rotates. Therefore, a movement path of the film thickness sensor across the surface of the wafer is different each time the polishing table makes one rotation. Normally, the film thickness distribution of the wafer is calculated as an averaged value in a circumferential direction based on signals acquired from different measurement points on a circumference.

In recent years, a degree of film thickness uniformity required has been increasing. As a result, it has become necessary to manage and control a polishing process in consideration of a variation in an initial film thickness of the wafer in the circumferential direction due to characteristics of a film forming apparatus and a variation in the amount of polishing in the circumferential direction caused by polishing (for example, it is effective to improve a uniformity of the film thickness distribution of the wafer by actively polishing areas where the film of the wafer is thick or by actively polishing areas other than the areas where the film of the wafer is thin).

SUMMARY

Therefore, there are provided a polishing apparatus and a polishing method capable of acquiring accurate film thickness distribution information.

There is provided a method for outputting visualization information of accurate film thickness distribution.

Embodiments, which will be described below, relate to a polishing apparatus, a polishing method, and a method for outputting visualization information of a film thickness distribution on a substrate.

In an embodiment, there is provided a polishing apparatus comprising: a polishing table configured to support a polishing pad; a plurality of film thickness sensors embedded in the polishing table, the film thickness sensors outputting a plurality of signals corresponding to a film thickness of a substrate; and a controller configured to measure film thickness information of the substrate based on the signals acquired from the film thickness sensors. When an inner region in contact with a peripheral edge portion of the substrate is defined as an inner edge portion and an outer region in contact with the peripheral edge portion of the substrate is defined as an outer edge portion on the polishing pad, the film thickness sensors are arranged from the inner edge portion to the outer edge portion, and the controller analyzes film thickness distribution information of the substrate while identifying a notch position of the substrate based on the measured film thickness information, and outputs visualization information of a film thickness distribution with the notch position as a reference position.

In an embodiment, each of the film thickness sensors comprises a PSD sensor.

In an embodiment, the controller comprises a median filter unit configured to perform a median filter on the signals acquired from each of the film thickness sensors, and the median filter unit performs the median filter on the signals acquired from each of the film thickness sensors, and removes noise from the signals.

In an embodiment, the polishing apparatus comprises a wear amount detection device configured to output a signal corresponding to the amount of wear of the polishing pad, and the controller is configured to: measure the amount of wear of the polishing pad based on the signal acquired from the wear amount detection device; and correct film thickness information based on the measured the amount of wear of the polishing pad.

In an embodiment, the polishing apparatus comprises a display device connected to the controller, and the controller is configured to output visualization information of the film thickness distribution to the display device.

In an embodiment, there is provided a polishing apparatus comprising: a polishing table configured to support a polishing pad; a polishing head having a plurality of pressing elements for pressing a substrate against a polishing surface of the polishing pad; a pressing force controller configured to be able to individually control pressing forces of the pressing elements; a plurality of film thickness sensors embedded in the polishing table, the film thickness sensors outputting a plurality of signals corresponding to a film thickness of a substrate; and a controller configured to measure film thickness information of the substrate based on the signals acquired from the film thickness sensors. The pressing elements are arranged at least along a circumferential direction of the polishing head, when an inner region in contact with a peripheral edge portion of the substrate is defined as an inner edge portion and an outer region in contact with the peripheral edge portion of the substrate is defined as an outer edge portion on the polishing pad, the film thickness sensors are arranged from the inner edge portion to the outer edge portion, and the controller is configured to control the pressing force at a specific position on the substrate by controlling a specific pressing element via the pressing force controller based on the measured film thickness information.

In an embodiment, the polishing apparatus comprises a rotation angle detector configured to detect a rotation angle of the polishing head, and the controller is configured to control the pressing force at the specific position on the substrate by controlling the specific pressing element via the pressing force controller based on the rotation angle of the polishing head acquired from the rotation angle detector and the measured film thickness information.

In an embodiment, the controller is configured to: identify a notch position of the substrate based on the measured film thickness information; and determine the specific position on the substrate from a relationship between the rotation angle of the polishing head and the notch position to control the pressing force at the specific position on the substrate by controlling the specific pressing element via the pressing force controller.

In an embodiment, the controller is configured to: identify the specific position on the substrate based on the measured film thickness information; and control the pressing force at the specific position on the substrate by controlling the specific pressing element via the pressing force controller based on a relationship between the rotation angle of the polishing head and the specific position on the substrate.

In an embodiment, there is provided a method for outputting visualization information of a film thickness distribution on a substrate, comprising: when an inner region in contact with a peripheral edge portion of the substrate is defined as an inner edge portion and an outer region in contact with the peripheral edge portion of the substrate is defined as an outer edge portion on the polishing pad, acquiring a plurality of signals corresponding to a film thickness of the substrate from a plurality of film thickness sensors arranged from the inner edge portion to the outer edge portion; measuring film thickness information of the substrate based on the acquired signals; and analyzing film thickness distribution information of the substrate while identifying a notch position of the substrate based on the measured film thickness information to output visualization information of the film thickness distribution with the notch position as a reference position.

In an embodiment, comprising: acquiring the signals corresponding to the film thickness of the substrate from a plurality of PSD sensors.

In an embodiment, comprising: performing a median filter on the acquired signals to remove noise from the signals.

In an embodiment, comprising: acquiring a signal corresponding to the amount of wear of the polishing pad from a wear amount detection device; measuring the amount of wear of the polishing pad based on the acquired signal; and correcting film thickness distribution information of the substrate based on the measured amount of wear of the polishing pad.

In an embodiment, comprising: outputting visualization information of the film thickness distribution to a display device.

In an embodiment, there is provided a polishing method comprising: when an inner region in contact with a peripheral edge portion of a substrate is defined as an inner edge portion and an outer region in contact with the peripheral edge portion of the substrate is defined as an outer edge portion on a polishing pad, acquiring a plurality of signals corresponding to a film thickness of the substrate from a plurality of film thickness sensors arranged from the inner edge portion to the outer edge portion; measuring film thickness information of the substrate based on the acquired signals; and controlling a pressing force at a specific position on the substrate by controlling a plurality of pressing elements for pressing the substrate against a polishing surface of the polishing pad based on the measured film thickness information, the pressing elements being arranged at least along a circumferential direction of a polishing head.

In an embodiment, comprising: acquiring a rotation angle of the polishing head by a rotation angle detector configured to detect a rotation angle of the polishing head; and controlling the pressing force of a specific position on the substrate by controlling the pressing elements based on the rotation angle of the polishing head acquired from the rotation angle detector and the measured film thickness information.

In an embodiment, comprising: identifying a notch position of the substrate based on the measured film thickness information; and determining the specific position on the substrate from a relationship between the rotation angle of the polishing head and the notch position to control the pressing force of the specific position on the substrate by controlling the pressing elements.

In an embodiment, comprising: identifying the specific position on the substrate based on the measured film thickness information; and controlling the pressing force of the specific position on the substrate by controlling the pressing elements based on a relationship between the rotation angle of the polishing head and the specific position on the substrate.

The controller can acquire accurate film thickness distribution information including a notch position of the wafer by providing multiple film thickness sensors.

DESCRIPTION OF EMBODIMENTS

Figure 1:
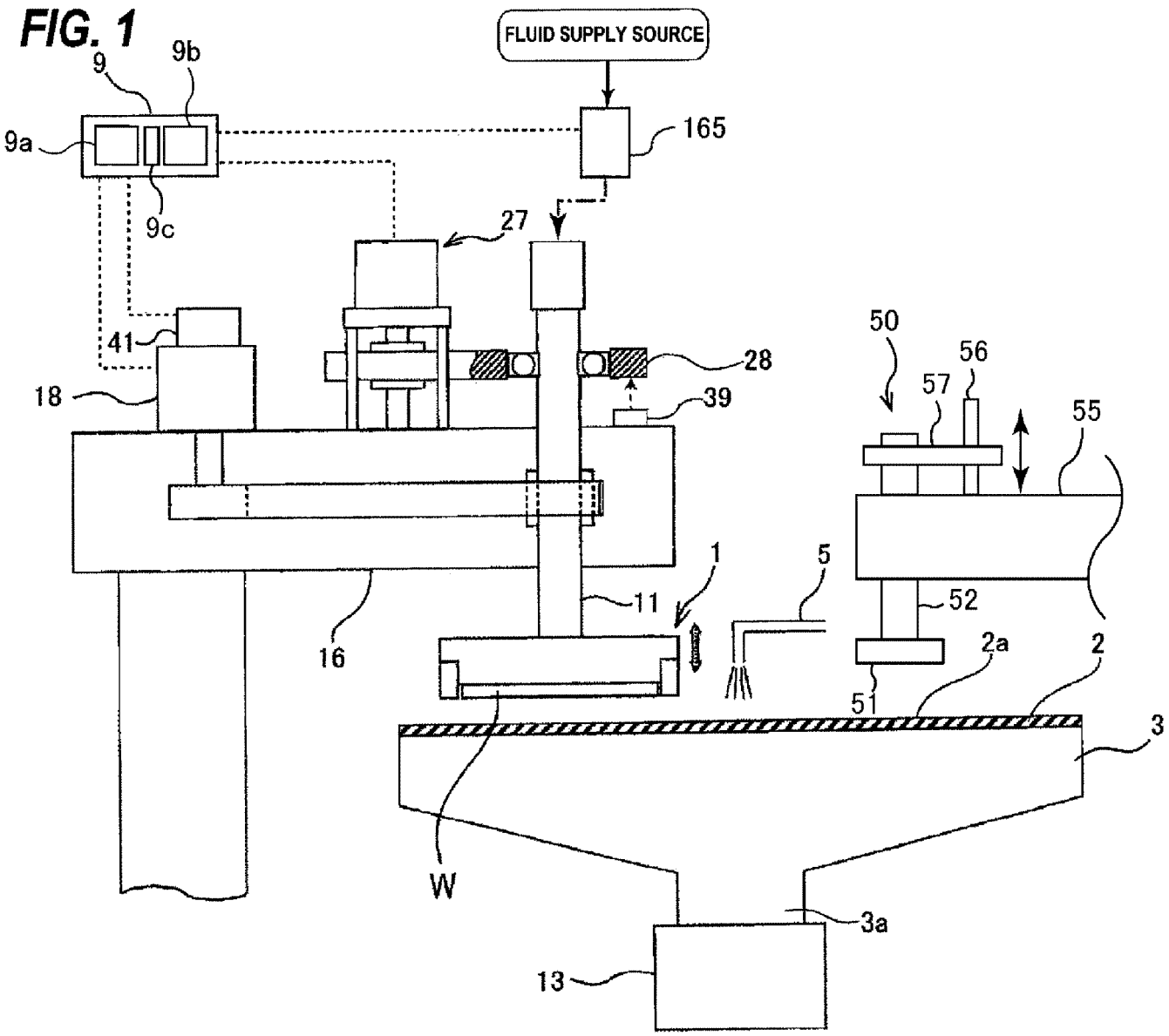
FIG. 1 is a schematic view of an embodiment of a polishing apparatus.

Embodiments will be described below with reference to the drawings. In the drawings described below, identical or corresponding components will be denoted by identical reference numerals, and repetitive descriptions thereof are omitted.

FIG. 1 is a schematic view of an embodiment of a polishing apparatus. As shown in FIG. 1, the polishing apparatus includes a polishing head (substrate holding apparatus) 1 that holds and rotates a wafer W, an example of a substrate, a polishing table 3 that supports a polishing pad 2, a polishing liquid supply nozzle 5 that supplies a polishing liquid (e.g., slurry) onto the polishing pad 2, and a controller 9 that controls operations of these components of the polishing apparatus.

The polishing head 1 and the polishing table 3 rotate in the same direction, and in this state, the polishing head 1 presses the wafer W against a polishing surface 2*a* of the polishing pad 2. A polishing fluid is supplied from the polishing liquid supply nozzle 5 onto the polishing pad 2, and the wafer W is polished by sliding against the polishing pad 2 in the presence of the polishing fluid.

The polishing table 3 is coupled to a table motor 13 arranged below the polishing table 3 via a table shaft 3*a*, and is rotatable around the table shaft 3*a*. The polishing pad 2 is attached to an upper surface of the polishing table 3, and the upper surface of the polishing pad 2 constitutes the polishing surface 2*a* for polishing the wafer W. When the polishing table 3 rotates by the table motor 13, the polishing surface 2*a* moves relative to the polishing head 1. Therefore, the table motor 13 constitutes a polishing surface moving mechanism that moves the polishing surface 2*a* in a horizontal direction.

The polishing head 1 is connected to a polishing head shaft 11, and the polishing head shaft 11 moves up and down with respect to a head arm 16 by a vertical movement mechanism 27. The entire polishing head 1 is moved up and down with respect to the head arm 16 for positioning by moving the polishing head shaft 11 up and down.

The controller 9 is composed of at least one computer. The controller 9 includes a memory unit 9*a* in which programs are stored, and a processing unit 9*b* that executes operations according to instructions included in the programs. The processing unit 9*b* includes a CPU (central processing unit) or a GPU (graphic processing unit) that executes operations according to instructions included in the programs stored in the memory unit 9*a*.

The head arm 16 is provided with a polishing head height sensor 39 facing a bridge 28. The polishing head height sensor 39 is electrically connected to the controller 9. The polishing head height sensor 39 detects a physical quantity corresponding to a height of the polishing head 1 based on a position of the bridge 28 that moves up and down integrally with the polishing head 1, and outputs a signal corresponding to the height. The controller 9 measures the height of the polishing head 1 based on the signal sent from the polishing head height sensor 39.

The polishing head 1 can be configured to hold the wafer W on a lower surface thereof. The polishing head 1 holding the wafer W on the lower surface moves from a delivery position of the wafer W to an upper position of the polishing table 3 by rotating of the head arm 16. The polishing head 1 and the polishing table 3 rotate, respectively, and the polishing liquid is supplied from the polishing liquid supply nozzle 5 provided above the polishing table 3 onto the polishing pad 2. The wafer W is pressed against the polishing surface 2*a* of the polishing pad 2 by the polishing head 1, and the wafer W is brought into sliding contact with the polishing surface 2*a* of the polishing pad 2 in the presence of the polishing liquid. The surface of the wafer W is polished by a chemical action of chemical components of the polishing liquid and a mechanical action of abrasive grains contained in the polishing liquid.

As shown in FIG. 1, the polishing apparatus includes a dressing unit 50 for dressing the polishing surface 2*a* of the polishing pad 2. The dressing unit 50 includes a dresser 51 that is slidably contacted with the polishing surface 2*a*, a dresser shaft 52 to which the dresser 51 is connected, and a swing arm 55 that rotatably supports the dresser shaft 52.

The dressing unit 50 includes a displacement sensor 56 that detects a displacement of the dresser 51. The displacement sensor 56 is provided on an upper surface of the swing arm 55. A target plate 57 is fixed to the dresser shaft 52. Therefore, the target plate 57 moves up and down as the dresser 51 moves up and down. The displacement sensor 56 is arranged so as to penetrate the target plate 57, and detects the displacement of the target plate 57 (i.e., the dresser 51). As the displacement sensor 56, any type of sensor such as a linear scale, a laser type sensor, an ultrasonic sensor, or an eddy current type sensor is used.

The displacement sensor 56 is a wear amount detection device that outputs a signal according to the amount of wear of the polishing pad 2. The controller 9 is electrically connected to the displacement sensor 56, and is configured to measure the amount of wear of the polishing pad 2 based on the signal acquired from the displacement sensor 56.

The amount of wear of the polishing pad 2 is measured as follows. First, the dresser 51 is lowered to bring the dresser 51 into contact with the polishing surface 2*a* of the initial polishing pad 2. In this state, the displacement sensor 56 detects the initial position of the dresser 51, and the controller 9 stores the initial position detected by the dresser 51 in the memory unit 9*a* of the controller 9. Thereafter, the dresser 51 is brought into contact with the polishing surface 2*a* of the polishing pad 2 again after the polishing of the wafer W is completed. In this state, the displacement sensor 56 detects the current position of the dresser 51. Since a lowering position of the dresser 51 is displaced downward according to the amount of wear of the polishing pad 2, the controller 9 calculates a difference between the initial position of the dresser 51 and the current position of the dresser 51 after polishing to measure the amount of wear of the polishing pad 2.

Figure 2:
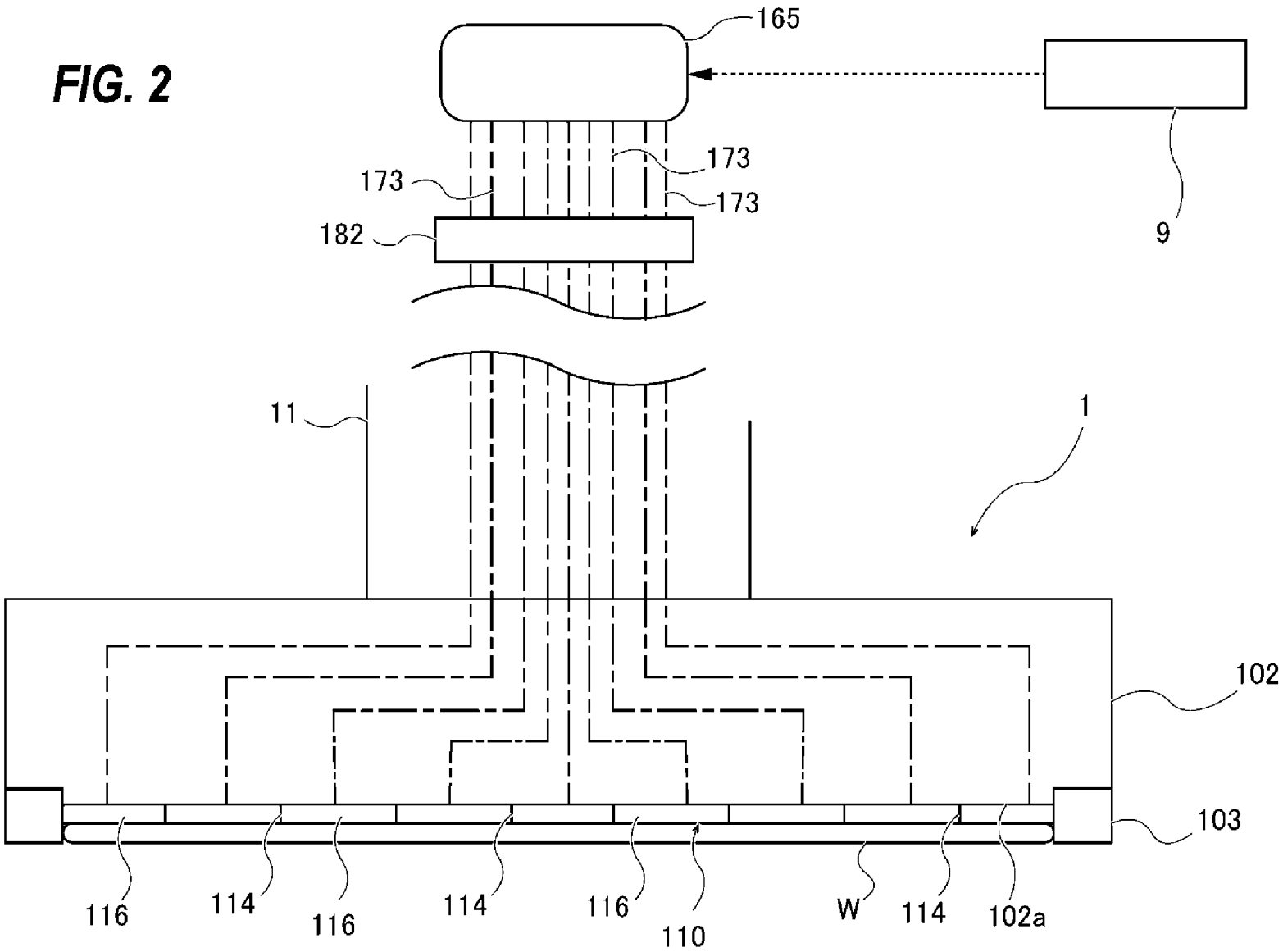
FIG. 2 is a schematic cross-sectional view of a polishing head.

Next, details of the polishing head 1 will be described with reference to the drawings. FIG. 2 is a schematic cross-sectional view of the polishing head. As shown in FIG. 2, the polishing head 1 includes a head body 102 that presses the wafer W against the polishing surface 2*a*, and a retaining ring 103 arranged so as to surround the wafer W. The retaining ring 103 is configured to be vertically movable independently of the head body 102.

The polishing head 1 has a plurality of pressing elements for pressing the wafer W against the polishing surface 2*a* of the polishing pad 2. An example of the pressing element may include a pressurizing mechanism provided in the polishing head 1 or a piezoelectric element provided in the polishing head 1. In the embodiment, the pressing element is a pressurizing mechanism provided on the polishing head 1. Hereinafter, details of the pressurizing mechanism will be described.

Figure 3:
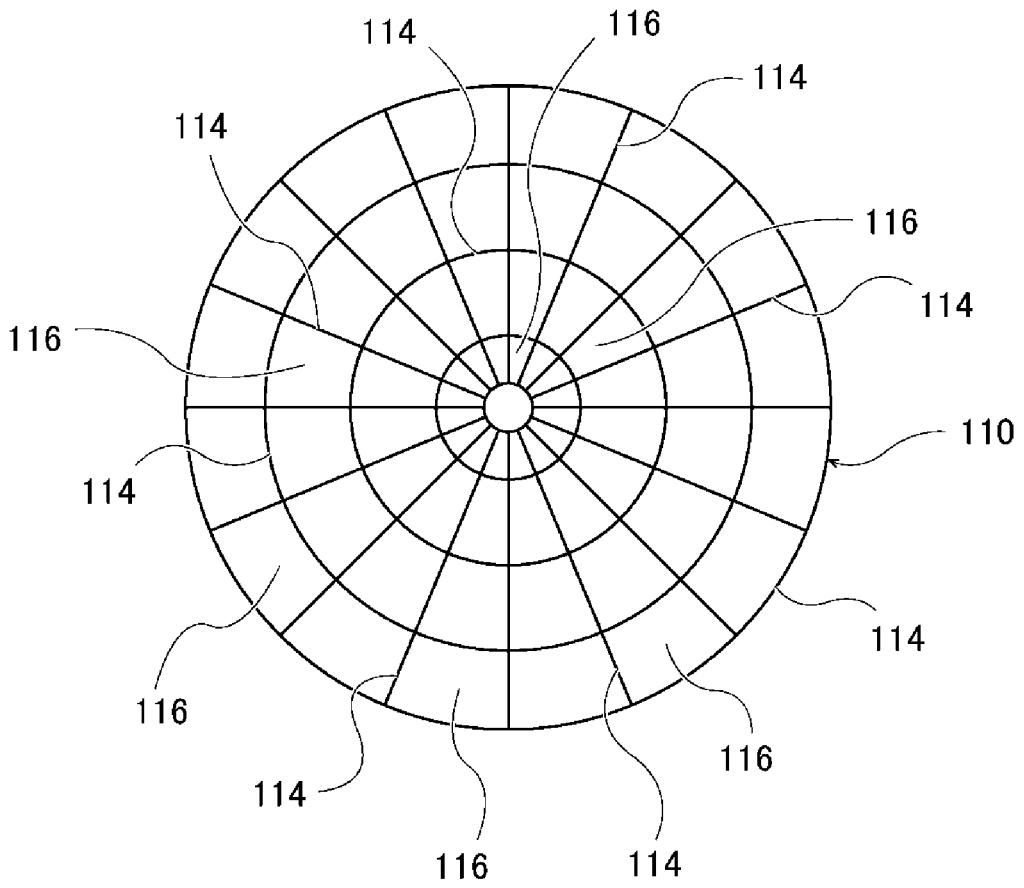
FIG. 3 is a schematic view showing an elastic membrane coupled to a lower surface of a head body.

FIG. 3 is a schematic view showing an elastic membrane coupled to a lower surface of the head body. As shown in FIGS. 2 and 3, an elastic membrane 110 that contacts on a back surface of the wafer W is coupled to the lower surface 102*a* of the head body 102. The elastic membrane 110 includes a plurality of walls 114. The walls 114 are arranged at least along the circumferential direction of the polishing head 1. In the embodiment shown in FIG. 3, the walls 114 are arranged along a radial direction and the circumferential direction of the polishing head 1. The retaining ring 103 is arranged so as to surround the elastic membrane 110. These walls 114 form a plurality of pressure chambers 116 arranged along the radial and the circumferential direction of the polishing head 1. The pressurizing mechanism as a pressing element has pressure chambers 116 formed in the elastic membrane 110. A fluid supply source (see FIG. 1) pressurizes the pressure chamber 116 by supplying the fluid to the pressure chamber 116.

In a case in which the pressing element is a piezoelectric element, the polishing head 1 includes a plurality of piezoelectric elements mounted on the lower surface 102*a* of the head body 102 instead of the elastic membrane 110. Similar to the pressure chamber 116, the piezoelectric elements are arranged along the radial direction and the circumferential direction of the polishing head 1.

The polishing apparatus includes a pressing force controller that can individually control the pressing force of the pressing elements. In the embodiment, the pressing force controller is a pressure regulating device 165 that individually regulates the pressure in the pressure chamber 116. These pressure chambers 116 are connected to the pressure regulating device (i.e., pressure regulator) 165 via a rotary joint 182, and a fluid (e.g., air) through a fluid line 173 extending from the pressure regulating device 165 to each pressure chamber 116 is to be supplied. The pressure regulating device 165 is connected to the controller 9 so that the pressure in these pressure chambers 116 can be regulated independently.

The pressure regulating device 165 can also form a negative pressure in the pressure chamber 116. Each pressure chamber 116 is also connected to an atmosphere opening mechanism (not shown), and the pressure chamber 116 can be opened to the atmosphere.

Figure 4A:
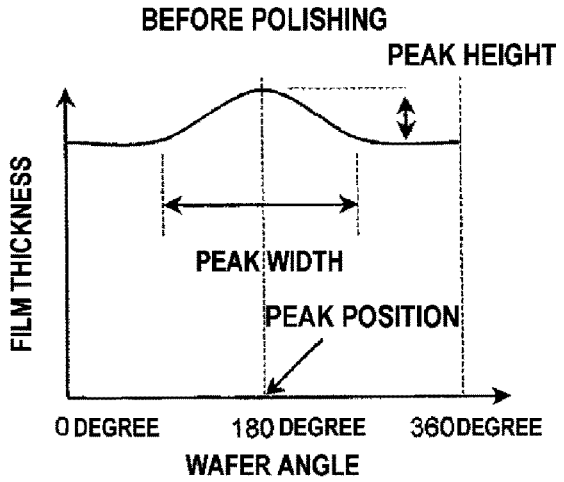
FIG. 4A, FIG. 4B, and FIG. 4C are views showing an example of a film thickness distribution along a circumferential direction of a wafer at a position 3 mm inner from an outermost end of the wafer.
Figure 4B:
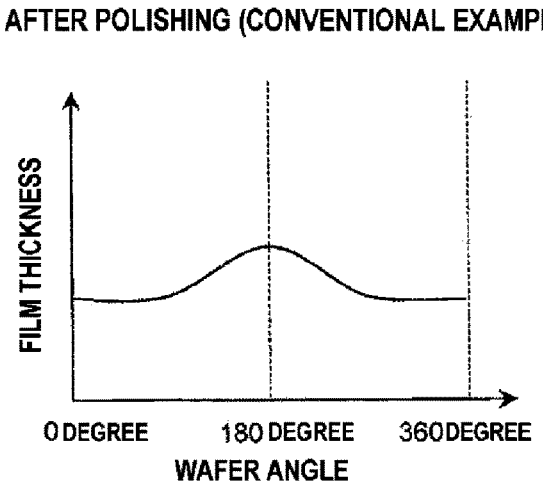
Figure 4C:
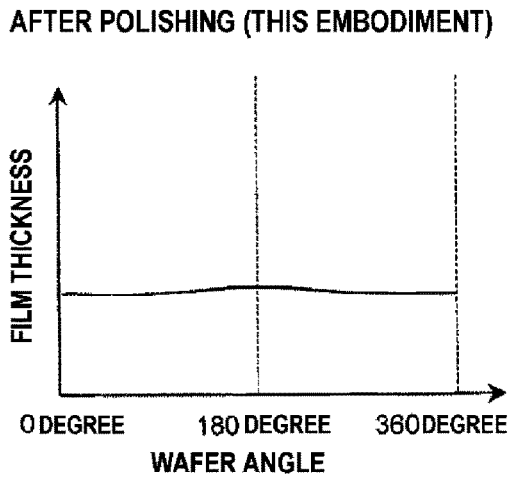

FIG. 4A, FIG. 4B, and FIG. 4C are views showing an example of the film thickness distribution along the circumferential direction of the wafer at a position 3 mm inner from an outermost end of the wafer. More specifically, FIG. 4A shows an initial film thickness distribution before polishing the wafer, FIG. 4B shows the film thickness distribution of the wafer when the wafer is polished by a conventional polishing apparatus, and FIG. 4 C schematically shows the film thickness distribution of the wafer when the wafer is polished by the polishing apparatus of this embodiment.

A position of the wafer angle of 0 degrees in FIGS. 4A to 4C is set at a characteristic position where the angle (or orientation) in the circumferential direction of the wafer can be specified. In the examples shown in FIGS. 4A to 4C, the position of the wafer angle of 0 degrees is a position of the notch formed on a peripheral edge portion of the wafer.

In the example shown in FIG. 4A, the initial film thickness distribution before polishing has a peak position at a wafer angle of 180 degrees, and FIG. 4A shows a variation in film thickness having a certain peak width and peak height. The cause of such an initial film thickness distribution is considered to be the characteristics of a film forming apparatus and an influence of various processes for forming the multilayer wiring.

In a case in which the wafer having the initial film thickness distribution shown in FIG. 4A is polished with a conventional polishing apparatus, the polishing proceeds almost uniformly in the circumferential direction. Therefore, as shown in FIG. 4B, the thickness distribution of the polished wafer remains almost the same as that before polishing. Such variations in the film thickness distribution may cause the focus to be out of focus in the next exposure process, resulting in a decrease in the yield of semiconductor manufacturing.

As shown in FIG. 4C, in a case in which the wafer having the initial film thickness distribution of FIG. 4A is polished by the polishing apparatus of the embodiment, a polishing rate at the peak position can be selectively increased. Therefore, it is possible to reduce the variation in film thickness in the circumferential direction as compared with the initial film thickness distribution.

Figure 5:
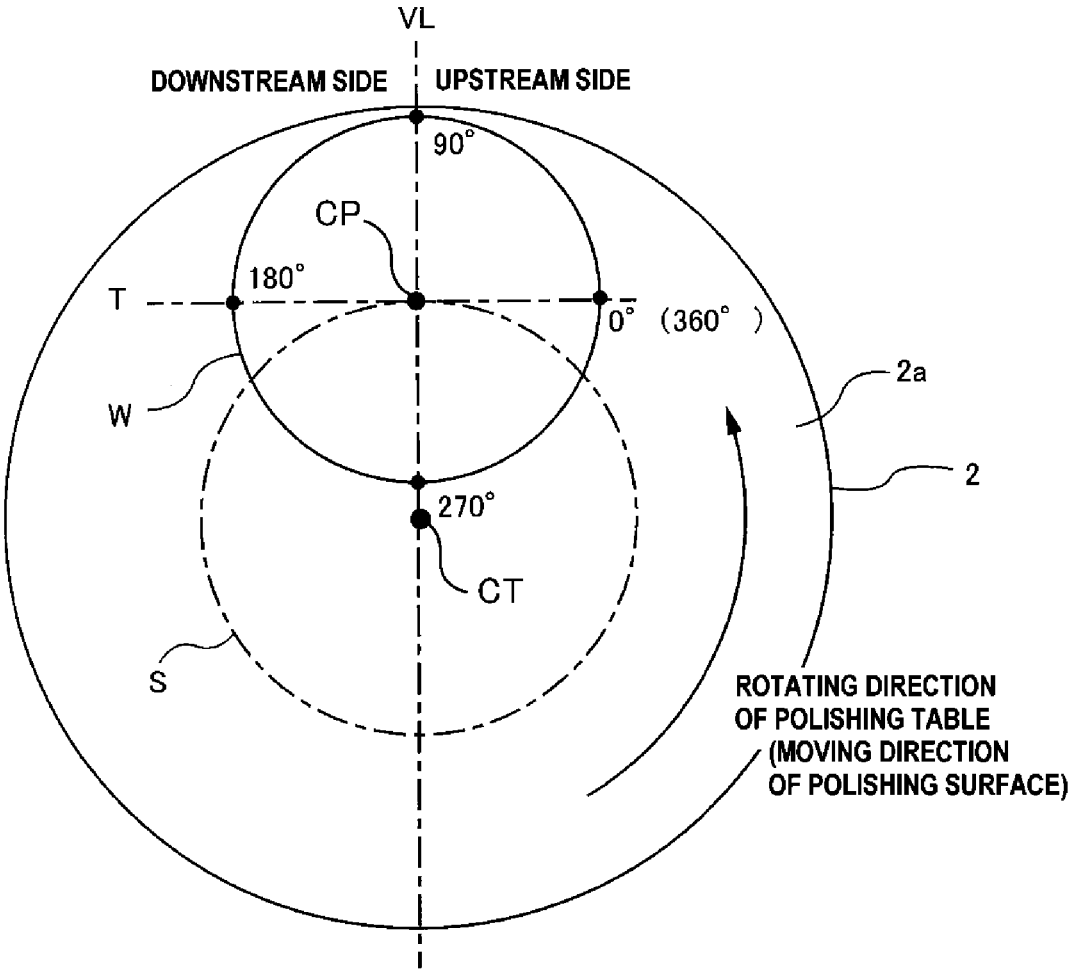
FIG. 5 is a view showing a positional relationship seen from above a polishing surface.

An embodiment for improving the variation in the film thickness distribution in the circumferential direction of the wafer by controlling a polishing rate distribution in the circumferential direction of the wafer will be described. FIG. 5 is a view showing a positional relationship seen from above the polishing surface. If a line connecting a center CP of the wafer W and a center CT of the polishing surface 2*a* is defined as an imaginary line VL, the polishing surface 2*a* is divided into an upstream side of the imaginary line VL and a downstream side of the imaginary line VL in a rotating direction thereof. The upstream side of the imaginary line VL and the downstream side of the imaginary line VL are, in other words, the upstream side and the downstream side of the wafer W with respect to a moving direction of the polishing surface 2*a*.

A circle S shown in FIG. 5 represents a rotation locus of the polishing surface 2*a* passing through the center CP of the wafer W. An intersection on the upstream side is set to a polishing head angle of 0 degrees, and an intersection on the downstream side is set to the polishing head angle of 180 degrees of two intersections of a tangent line T and a wafer circle at the wafer center CP of the circle S. An intersection on the center side of the polishing surface is set to the polishing head angle of 270 degrees, and an intersection on the outer peripheral side of the polishing surface is set to the polishing head angle of 90 degrees of the two intersections of the imaginary line VL and the wafer circle. The wafer circle is a circle representing the outermost end of the wafer W. The polishing head angle is an initial rotation angle at the position of the polishing head 1 before polishing the wafer, more specifically, at the position of the polishing head 1 when the polishing head 1 holding the wafer is arranged above the polishing pad 2. The rotation angle of the polishing head 1 is detected by a rotary encoder 41 (see FIG. 1) attached to the polishing head motor 18. The rotary encoder 41 is a rotation angle detector that detects the rotation angle of the polishing head 1.

In order to control the variation in the film thickness in the circumferential direction of the wafer or to control the polishing pressure, it is necessary to grasp the film thickness at a specific position on the wafer. It is necessary to acquire the film thickness distribution on the wafer based on a reference position of the wafer angle (in this embodiment, the notch position). In order to acquire the film thickness distribution in the wafer surface during polishing, it is necessary to grasp the notch position of the wafer during polishing.

Assuming that an orientation of the wafer with respect to the polishing head 1 does not change from a start of polishing to an end of polishing, in other words, the wafer does not shift in the circumferential direction with respect to the polishing head 1, it is possible to measure the film thickness at the specific position on the wafer by keeping a mounting angle of the wafer with respect to the polishing head 1 at a start of polishing always constant and grasping the angle of the polishing head 1 by the rotary encoder 41 (see FIG. 1) and by calculating a scanning locus of a film thickness sensor 60 (described later) on the wafer from the positional relationship between the rotation angle of the polishing head 1 and the film thickness sensor 60.

However, the wafer may be displaced in the circumferential direction in the polishing head 1 due to a fictional force between the polishing pad 2 and the wafer. Further, there cases where it may be difficult to keep the constant mounting angle of the wafer with respect to the polishing head at a constant level at the start of polishing. Further, as in a conventional case, if only one film thickness sensor for measuring the film thickness in a limited range is provided in the polishing table 3, measurement points on the wafer acquired during one rotation of the polishing table 3 is limited to a passage trajectory of the arc-shaped sensor and is insufficient for real-time measurement of the polishing film thickness.

In order to improve the uniformity of the film thickness distribution, it is important to acquire accurate film thickness distribution information during the polishing of the wafer. Further, in order to acquire accurate film thickness distribution information, it is important to accurately identify the reference position of the wafer angle (notch position in this embodiment). Therefore, the polishing apparatus is configured to acquire accurate film thickness distribution information during polishing of the wafer to improve the uniformity of the wafer film thickness distribution. In the embodiment, the reference position of the angle in the circumferential direction of the wafer is a position of the notch. A polishing apparatus having such a configuration will be described with reference to the drawings.

Figure 6:
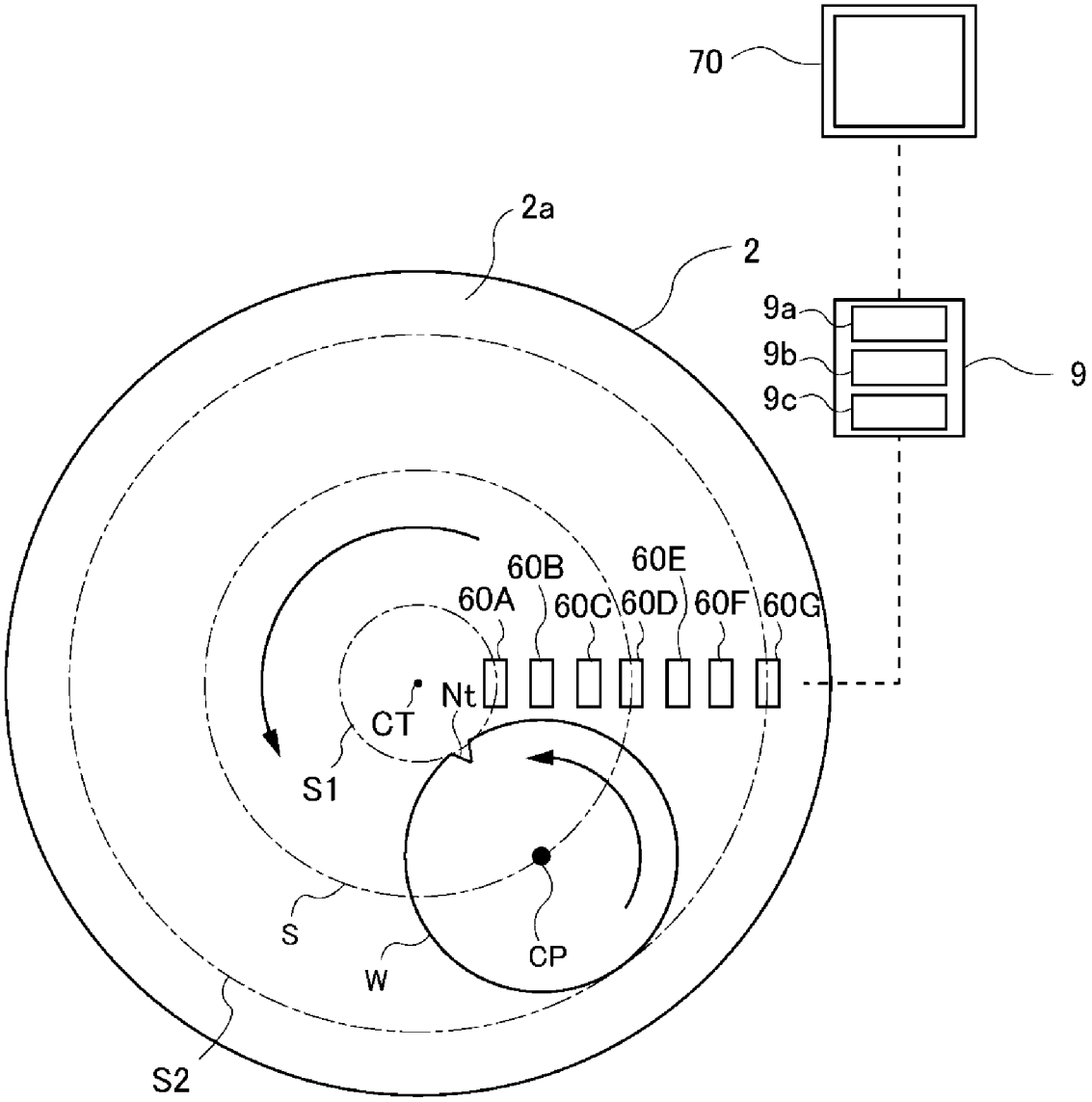
FIG. 6 is a view showing a plurality of film thickness sensors embedded in the polishing pad.

FIG. 6 is a view showing a plurality of film thickness sensors embedded in the polishing pad. As shown in FIG. 6, the polishing apparatus includes a plurality of film thickness sensors 60A to 60G that each detects a plurality of physical quantities corresponding to the thickness of the wafer W and each outputs a plurality of signals corresponding to the film thickness of the wafer W. Hereinafter, in the specification, the film thickness sensors 60A to 60G may be simply referred to as the film thickness sensor 60 without distinguishing them.

In FIG. 6, the circle S represents the rotation locus of the polishing surface 2*a* (i.e., the film thickness sensor 60D) passing through the center CP of the wafer W. The circle 51 represents the rotation locus of the polishing surface 2*a* (i.e., the film thickness sensor 60A) passing through the peripheral edge portion of the wafer W on the center side of the polishing pad 2. The circle S2 represents the rotation locus of the polishing surface 2*a* (i.e., the film thickness sensor 60G) passing through the peripheral edge portion of the wafer W on the outer peripheral side of the polishing pad 2. The peripheral edge portion of the wafer W is the outermost end portion of the wafer W on which a notch Nt is formed and the wafer circle is formed.

The circle 51 is a virtual inner edge portion that is centered on the center CT of the polishing pad 2 and is in contact with the peripheral edge portion of the wafer W on the center side of the polishing pad 2. The circle S2 is a virtual outer edge portion that is in contact with the peripheral edge portion of the wafer W on the outer peripheral side of the polishing pad 2. In other words, the inner edge portion of a region in contact with the peripheral edge portion of the wafer W is the circle 51, and the outer edge portion is the circle S2 in the polishing surface 2*a* of the polishing pad 2. The inner edge portion is defined as an inner region on the polishing pad 2 to which the peripheral edge portion of the wafer W contacts (i.e., passes). The outer edge portion is defined as an outer region on the polishing pad 2 to which the peripheral edge portion of the wafer W contacts (i.e., passes).

As shown in FIG. 6, the film thickness sensors 60A to 60G are arranged from the inner edge portion to the outer edge portion. The film thickness sensor 60A crosses the peripheral edge of the wafer W on the center side of the polishing pad 2 each time the polishing table 3 makes one rotation. The film thickness sensor 60G crosses the peripheral edge of the wafer W on the outer side of the polishing pad 2 each time the polishing table 3 makes one rotation.

In the embodiment shown in FIG. 6, a plurality of (more specifically, five) film thickness sensors 60B to 60F are arranged between the film thickness sensor 60A and the film thickness sensor 60G. However, the number of film thickness sensors 60 arranged between the film thickness sensor 60A and the film thickness sensor 60G is not limited to this embodiment. At least one film thickness sensor 60 capable of measuring the film thickness distribution over the region sandwiched between the circles S1 and S2 may be arranged. In order to acquire more accurate film thickness distribution information, it is preferable that a plurality of (many) film thickness sensors 60 are arranged between the film thickness sensor 60A and the film thickness sensor 60G.

Each of the film thickness sensors 60A to 60G is configured to detect a physical quantity corresponding to the film thickness that changes according to the film thickness of the wafer W. An example of the film thickness sensor 60 includes an optical sensor or an eddy current sensor. As the film thickness sensor 60, an optical sensor is preferable, and a PSD (Position Sensitive Detector) sensor is more preferable. An example of the PSD sensor includes GP2Y0A21YK manufactured by Sharp Corporation.

In a case in which the film thickness sensor 60 includes the eddy current sensor, the eddy current sensor detects eddy currents in accordance with the film thickness of the wafer W to output an eddy current signal by causing sensor coil of the eddy current sensor to pass magnetic flux through a conductive film of the wafer W and generate eddy currents.

In a case in which the film thickness sensor 60 includes the PSD sensor, the PSD sensor detects a voltage signal corresponding to the film thickness of the wafer W based on a triangulation method. More specifically, the PSD sensor emits light to the wafer W and detects the voltage corresponding to the angle of a light reflected from the wafer W. A reflection angle of the light differs depending on the distance from the PSD sensor to the wafer W, and the magnitude of the voltage corresponding to the reflection angle also differs. Therefore, the PSD sensor detects the voltage corresponding to the film thickness of the wafer W based on the reflection angle of the light emitted to the wafer W, and outputs a voltage signal.

As shown in FIG. 6, the controller 9 is electrically connected to each of the film thickness sensors 60A to 60G. The controller 9 is configured to measure film thickness information of the wafer W based on a plurality of signals acquired from the film thickness sensors 60A to 60G. The memory unit 9*a* of the controller 9 stores data indicating a correlation between the signals acquired from the film thickness sensors and the film thickness of the wafer W, and the processing unit 9*b* measures film thickness information of the wafer W based on data stored in the memory unit 9*a*.

In one embodiment, the film thickness sensor 60 as the PSD sensor first detects a voltage corresponding to the film thickness of a reference wafer W, which is a reference whose film thickness is known, and sends a voltage signal to the controller 9. The memory unit 9*a* of the controller 9 stores in advance data (film thickness data) of the output voltage with respect to the film thickness of the reference wafer W.

Thereafter, the film thickness sensor 60 detects a voltage corresponding to the film thickness of the wafer W to be polished during polishing, and sends a voltage signal to the controller 9. The processing unit 9*b* of the controller 9 calculates a difference from the voltage value corresponding to the film thickness of the wafer W to be polished with reference to the voltage value corresponding to the film thickness of the reference wafer W. The memory unit 9*a* stores data (distance data) showing the correlation between the difference and the distance between the film thickness sensor 60 and the wafer W. Therefore, the processing unit 9*b* determines the film thickness of the wafer W to be polished based on the film thickness data and the distance data.

The film thickness sensors 60A to 60G are arranged in the polishing table 3, and are arranged in this order along the radial direction of the polishing table 3. It is desirable that the distance between the film thickness sensors 60A to 60G is larger than the diameter of the wafer W. Therefore, the film thickness sensor 60 detects a voltage corresponding to the film thickness in the entire area of the wafer W each time the polishing table 3 rotates once. In other words, the film thickness sensors 60A to 60G are arranged so as to extend from the inner edge portion to the outer edge portion on the polishing table 3 corresponding to the region through which the wafer W on the polishing pad 2 passes. The film thickness sensors 60A to 60G does not have to be arranged along the radial direction of the polishing table 3. Further, one film thickness sensor having a continuous measurement region capable of measuring the film thickness in the entire area of the wafer W may be used instead of the film thickness sensors 60A to 60G.

The film thickness sensor 60A moves along the rotation locus (see the circle S1 in FIG. 6) by rotating the polishing table 3, and detects a voltage corresponding to the film thickness of the peripheral edge portion of the wafer W on the rotation locus. In other words, any specific point on the peripheral edge portion of the wafer W moves to the position (i.e., the position of the intersection of the wafer circle of the wafer W and the circle S1) closest to the center CT of the polishing pad 2 by rotating the polishing head 1. At this time, the film thickness sensor 60A detects the voltage at the specific point. The film thickness sensor 60A that has detected the voltage outputs a voltage signal to the controller 9.

The film thickness sensor 60D moves along the rotation locus (see the circle S in FIG. 6) by rotating the polishing table 3, and detects the voltage at a specific point on the rotation locus including the center CP of the wafer W to output the voltage signal to the controller 9.

The film thickness sensor 60G moves along the rotation locus (see the circle S2 in FIG. 6) by rotating the polishing table 3, and detects a voltage corresponding to the film thickness of the peripheral edge portion of the wafer W on the rotation locus. In other words, any specific point on the peripheral edge portion of the wafer W moves to the position farthest from the center CT of the polishing pad 2 (i.e., the position of the intersection of the wafer circle of the wafer W and the circle S2) by rotating the polishing head 1. At this time, the film thickness sensor 60G detects the voltage at the specific point. The film thickness sensor 60G that has detected the voltage outputs a voltage signal to the controller 9.

As shown in FIG. 6, the notch Nt of the wafer W is formed on the peripheral edge portion of the wafer W. Therefore, at least one of the film thickness sensors 60A to 60G can reliably detect the notch Nt of the wafer W each time the polishing table 3 rotates once. In particular, when the film thickness sensor 60 is the PSD sensor, the PSD sensor is configured to detect a change in the distance from itself to the object to be measured. Therefore, the controller 9 can reliably identify the position of the notch Nt on the wafer W. By using the PSD sensor, the controller 9 can measure the film thickness in a small region on the wafer W by a spot diameter of light. Therefore, the controller 9 can measure more detailed film thickness information.

Further, the controller 9 is configured to analyze film thickness distribution information of the wafer W while identifying the notch position of the wafer W based on the measured film thickness information, and output visualization information of the film thickness distribution with the notch position as the reference position. The controller 9 determines the position (i.e., the angle of the notch Nt or the angle of the wafer W) of the notch Nt during polishing to calculate the position measured based on the film thickness sensor 60 during polishing as the reference position on the wafer with respect to the notch Nt.

The controller 9 associates the film thickness measured based on the film thickness sensor 60 with the measurement point on the wafer based on the notch Nt. By using the film thickness sensors 60A to 60G, the controller 9 can measure the film thickness distribution in the entire region in the wafer W for each rotation of the wafer W. The film thickness distribution may be calculated by averaging the measured values during several rotations of the polishing table 3. The accuracy of film thickness measurement can be improved.

According to the embodiment, by providing the plurality of film thickness sensors 60, the controller 9 can acquire accurate film thickness distribution information including the position of the notch Nt of the wafer W. As a result, the controller 9 can execute a mapping of the film thickness of the wafer W, and can output the visualization information of the accurate film thickness distribution with the notch position as the reference position.

Figure 7:
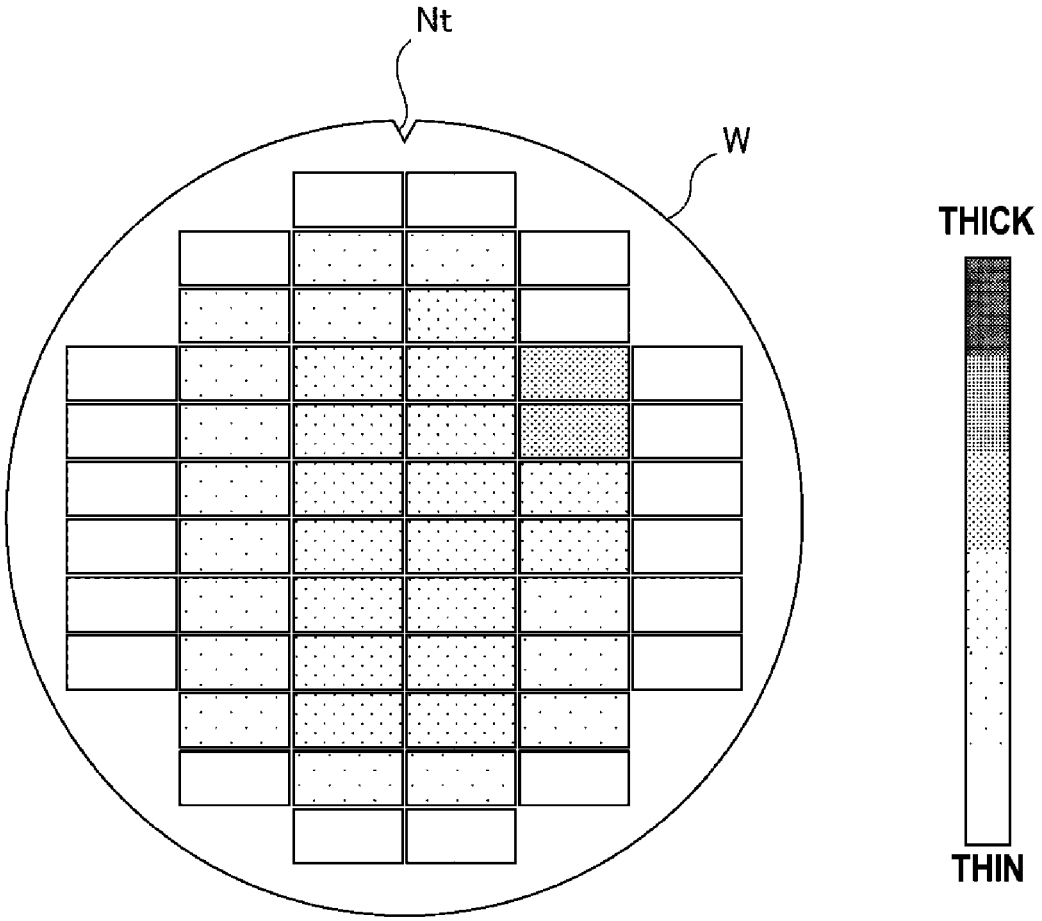
FIG. 7 is a view showing visualization information of the film thickness distribution output to a display device.

FIG. 7 is a view showing visualization information of the film thickness distribution output to a display device. In FIG. 7, an example of visualization information of the film thickness distribution is drawn. The controller 9 is electrically connected to a display device 70 (see FIG. 6) that displays visualization information of the film thickness distribution.

The processing unit 9*b* of the controller 9 compares the signal acquired from the film thickness sensor 60 with the data stored in the memory unit 9*a*, and measures film thickness information of the wafer W to identify the position of the notch Nt of the wafer W. Further, the processing unit 9*b* acquires film thickness distribution information from film thickness information of the wafer W and the position of the notch Nt, and analyzes film thickness distribution information to acquire visualization information of the film thickness distribution. As shown in FIG. 7, in the film thickness distribution visualization information, the surface of the wafer W is virtually divided into a plurality of regions, and the relative film thickness is visualized for each divided region.

The controller 9 outputs visualization information of the film thickness distribution of the wafer W as shown in FIG. 7 to the display device 70. The display device 70 displays this visualization information. Therefore, an operator can grasp the film thickness of the wafer W through the display device 70.

The film thickness sensor 60 detects the physical quantity corresponding to the film thickness of the wafer W each time the film thickness sensor 60 passes through the wafer W during polishing the wafer W, and sends a signal corresponding to the film thickness of the wafer W to the controller 9. Therefore, the controller 9 constantly analyzes the acquired film thickness distribution information during the polishing of the wafer W, and continuously updates visualization information of the film thickness distribution output to the display device 70. As a result, the operator can grasp the constantly changing film thickness of the wafer W in real time during the polishing of the wafer W.

As shown in FIGS. 1 and 6, the controller 9 may include a median filter unit 9*c* that performs a median filter on the signals acquired from each of the film thickness sensors 60. The median filter unit 9*c* performs the median filter on a plurality of signals acquired from each of the film thickness sensors 60, and removes noise from the plurality of signals.

Figure 8:
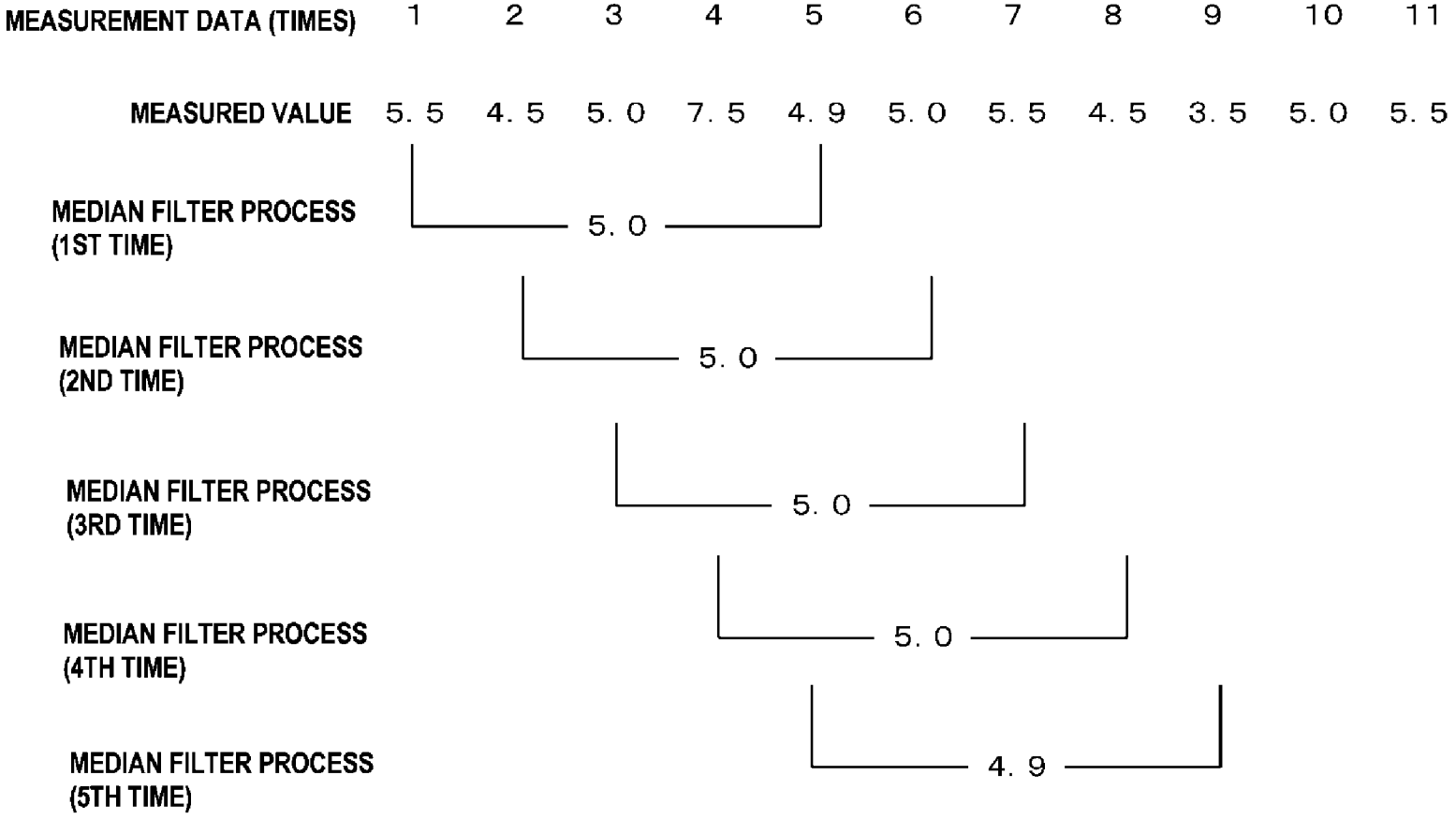
FIG. 8 is a view for explaining a median filter.

FIG. 8 is a view for explaining the median filter. In the embodiment shown in FIG. 8, the median filter will be described based on an arbitrary numerical value. The median filter is a noise removal process that suppresses sudden data variation by extracting an intermediate value among a plurality of set numerical values as data. In FIG. 8, 11 measurement data are detected by a single film thickness sensor 60. For example, when the median filter unit 9*c* performs the median filter on the measured values of the measurement data from the first to the fifth time, among the numerical values of 5.5, 4.5, 5.0, 7.5, 4.9, the median value of 5.0 is adopted as the measured value.

In a case in which the PSD sensor is adopted as the film thickness sensor 60, noise is relatively likely to occur in a reflection type ranging sensor such as the PSD sensor. In particular, in the wafer W on which the wiring is formed, noise may occur in regions where the wiring heights are different. Since the median filter unit 9*c* can remove the noise of the measured value, the median filter unit 9*c* can effectively exert its function, particularly when the PSD sensor is adopted as the film thickness sensor 60.

Figure 9:
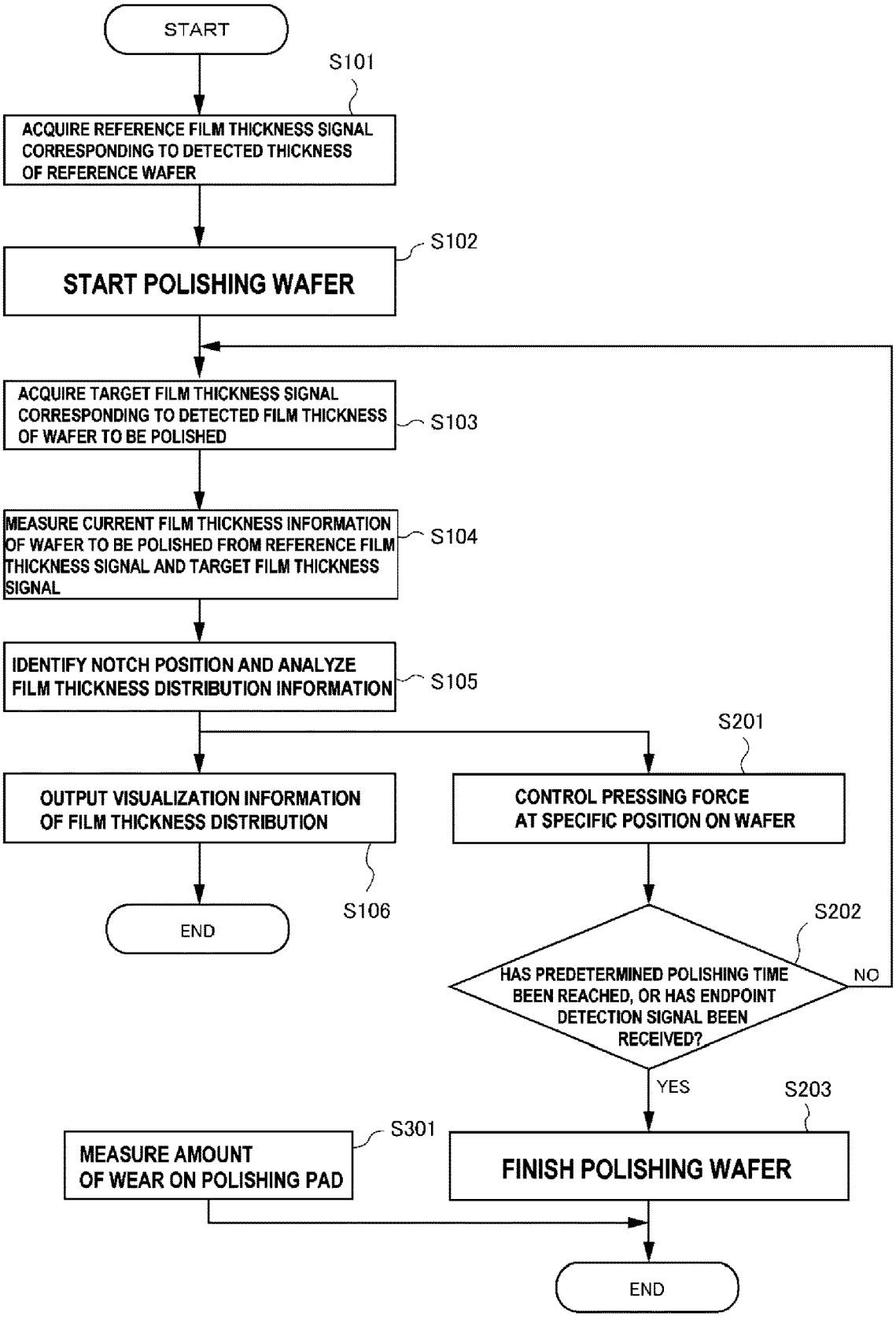
FIG. 9 is a view showing a flowchart including a step of outputting visualization information of the film thickness distribution.

FIG. 9 is a view showing a flowchart including a step of outputting visualization information of the film thickness distribution. FIG. 9 shows a flowchart in a case in which the PSD sensor is adopted as the film thickness sensor 60. As shown in step S101 of FIG. 9, the controller 9 acquires a signal (reference film thickness signal) corresponding to the film thickness of the reference wafer W detected by the film thickness sensor 60. The memory unit 9*a* of the controller 9 stores the film thickness data regarding the film thickness of the reference wafer W.

The controller 9 starts polishing the wafer W to be polished (see step S102), and acquires a signal (target film thickness signal) corresponding to the film thickness of the wafer W to be polished detected by the film thickness sensor 60 (see step S103). The controller 9 measures film thickness information of the current wafer W to be polished (see step S104) based on the reference film thickness signal acquired by step S101, the target film thickness signal acquired by step S103, and the film thickness data stored in the memory unit 9*a*.

The controller 9 identifies the notch position based on film thickness information measured in step S104, acquires and analyzes film thickness distribution information of the wafer W to be polished (see step S105), and outputs visualization information of the film thickness distribution with the notch position as the reference position (see step S106).

As shown in step S201 of FIG. 9, the controller 9 analyzes film thickness distribution information of the wafer W and controls a specific pressing element via the pressing force controller to control the pressing force at a specific position on the wafer W. In order to increase the uniformity of the film thickness distribution of the wafer W, the controller 9 operates the pressing force controller (in this embodiment, the pressure regulating device 165) based on film thickness information measured based on the rotation angle of the polishing head 1 acquired from the rotary encoder 41 (see FIG. 1) as a rotation angle detector for detecting the rotation angle of the polishing head 1 and the signal acquired from the film thickness sensor 60. By this operation, the controller 9 controls the pressing force of the pressing element (in this embodiment, the pressure of the fluid supplied to the pressure chamber 116) individually to aggressively polish the areas of the wafer W where the film is thick, or aggressively polish the areas other than areas where the film of the wafer W is thin.

In this embodiment, in order to control the pressing force at the specific position on the wafer W, the pressure in the pressure chamber 116 divided along at least the circumferential direction of the polishing head is individually controlled, but the embodiment of the polishing head is not limited. Any polishing head having a pressing element that can apply different polishing pressures to different circumferential areas of the wafer W may be used.

Figure 10:
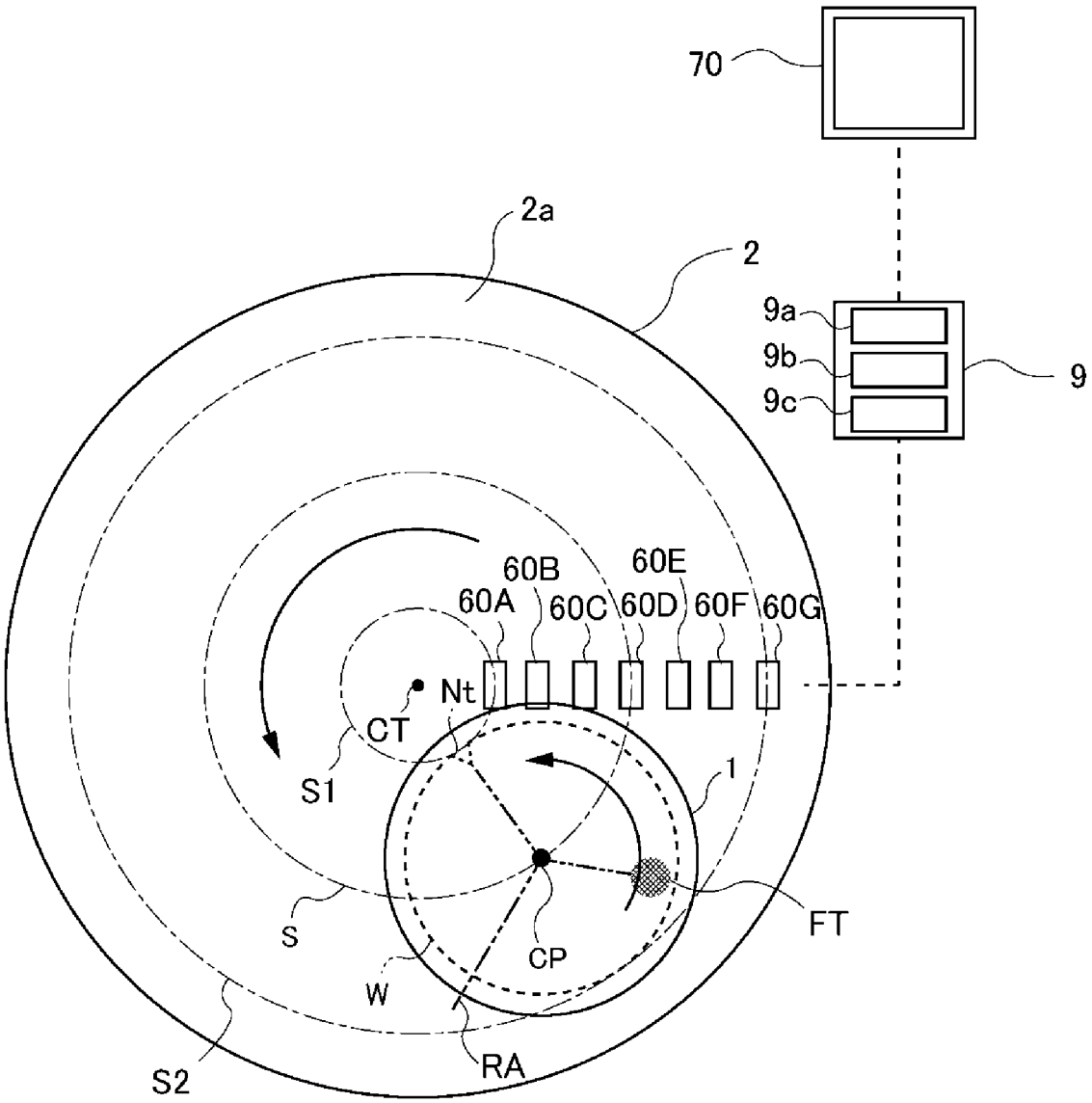
FIG. 10 is a view showing a relationship between a specific position on the wafer, a position of a notch, and a rotation angle of the polishing head.

FIG. 10 is a view showing the relationship between the specific position on the wafer, the position of the notch, and the rotation angle of the polishing head. By measuring the film thickness of the wafer W with a film thickness measuring device (not shown) provided in the polishing apparatus or a film thickness measuring device (not shown) different from the polishing apparatus, a specific position FT (not shown) on the wafer W (portions having a particularly thick film thickness or portions having a particularly thin film thickness) may be specified in advance. In this case, the controller 9 determines the relationship between the specific position FT and the position of the notch Nt, and stores this relationship in the memory unit 9*a*.

In a case in which the specific position FT on the wafer W is identified in advance, the controller 9 determines the relationship between the rotation angle of the polishing head 1 and the position of the notch Nt based on the signal sent from the rotary encoder 41 and the signal sent from the film thickness sensor 60. Since the relationship between the specific position FT and the position of the notch Nt is stored in the memory unit 9*a*, the controller 9 determines the angle (and the distance from the center of the wafer) of the specific position FT with respect to the rotation angle from the relationship between the rotation angle of the polishing head 1 and the position of the notch Nt, and controls the pressing element in the polishing head corresponding to the specific position FT to control the pressing force with respect to the specific position FT. The rotation angle is an angle with respect to a fixed coordinate system of a reference direction RA. The reference direction RA is a direction fixedly determined with respect to the polishing head 1 in order to determine the rotation angle of the polishing head 1.

Next, a case in which the controller 9 identifies the specific position FT on the wafer W based on the signal detected by the film thickness sensor 60 will be described. In a case in which there is a measurement point (singularity point of the film thickness) whose film thickness is higher (or lower) than other measurement points among film thickness information acquired from the film thickness sensor 60, the pressing element in the polishing head 1 corresponding to the specific position FT on the wafer W can be identified to control the pressing force based on the scanning locus on the wafer W of the film thickness sensor 60 and the rotation angle of the polishing head 1.

More preferably, as described above, the rotation angle of the polishing head 1 is acquired from the signal sent from the rotary encoder 41, and the position of the notch Nt is measured from the signal sent from the film thickness sensor 60. The pressing element in the polishing head 1 corresponding to the specific position FT on the wafer W is identified from the relationship between the position of the singularity point of the film thickness on the scanning locus of the film thickness sensor 60 and the position of the notch Nt, and the relationship between the rotation angle of the polishing head 1 and the position of the notch Nt. The reason is that there is a time delay from the time when the film thickness sensor 60 acquires the signal corresponding to the film thickness to the time when the film thickness is calculated and the pressing force of a specific pressing element is controlled, during which the wafer W is polished. This is because there is a possibility that the head 1 will be displaced. Further, in order to measure the film thickness with higher accuracy, it is desirable to average the film thickness acquired while the wafer W rotates several times. In this case, the time delay becomes larger, so it is desirable to identify the position of the notch Nt and identify the position of the pressing element in the polishing head 1. According to the embodiment, even if the wafer W is displaced with respect to the polishing head 1 during polishing, the pressure of the pressing element in the polishing head 1 corresponding to the specific position FT on the wafer W is adjusted to be able to improve the film thickness variation.

After performing step S201 of FIG. 9, the controller 9 finishes polishing the wafer W (see step S203) by reaching a predetermined polishing time or receiving an end point detection signal from the film thickness sensor 60 (see "YES" in step S202). If the predetermined polishing time has not been reached, or the controller 9 has not received the end point detection signal from the film thickness sensor 60 (see "NO" in step S202), the process shown in step S103 is repeated.

Figure 11:
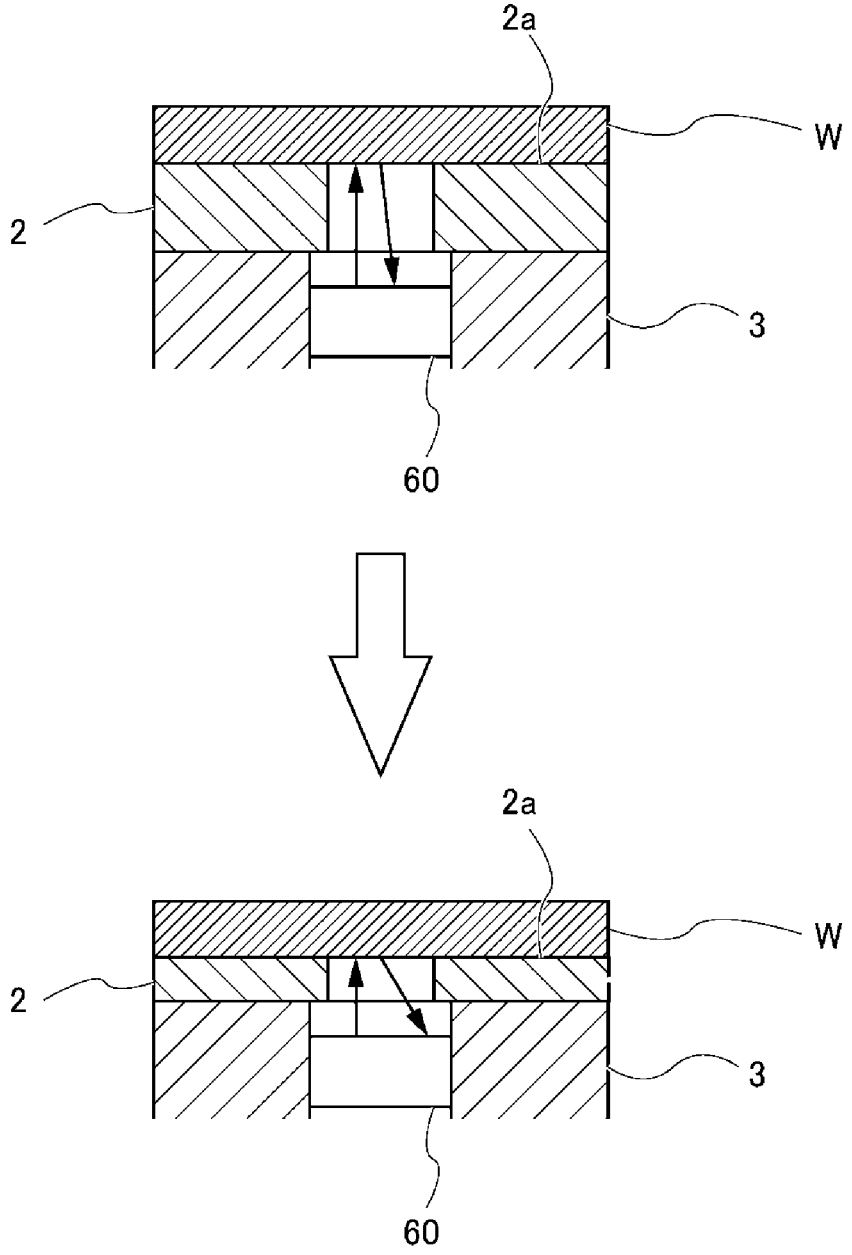
FIG. 11 is a view for explaining an embodiment in which film thickness information is corrected based on the amount of wear of the polishing pad.

FIG. 11 is a view for explaining an embodiment in which film thickness information is corrected based on the amount of wear of the polishing pad. In the embodiment shown in FIG. 11, the film thickness sensor 60 is the PSD sensor. The controller 9 may correct film thickness information based on the amount of wear on the polishing pad 2. When the dresser 51 is in sliding contact with the polishing surface 2*a* of the polishing pad 2, the polishing pad 2 is worn. As a result, the distance between the film thickness sensor 60 and the wafer W changes (see FIG. 11). Since the amount of wear on the polishing pad 2 affects a measurement of film thickness information of the wafer W, the processing unit 9*b* of the controller 9 may correct film thickness information of the wafer W based on the amount of wear of the polishing pad 2.

Film thickness information of the wafer W is corrected as follows. A plurality of polishing pads 2 having different amounts of wear (i.e., different thicknesses) and a reference wafer W having a known film thickness are prepared. First, the controller 9 presses the reference wafer W against the polishing surface 2*a* of the initial polishing pad 2 having zero wear (i.e., not worn), and acquires the signal (signal at an initial time) output by the film thickness sensor 60 at this time. Thereafter, the controller 9 presses the reference wafer W against the polishing surface 2*a* of the polishing pads 2 having different amounts of wear, and acquires the signal (signal after wear) output by the film thickness sensor 60 at this time. The film thickness of the measured reference wafers W are the same.

In this manner, the controller 9 calculates the difference between the signal at the initial time and the signal after wear, and uses this difference as the amount of correction to relate the amount of wear of the polishing pad 2 and the amount of correction. The associated correction data is stored in the memory unit 9*a*.

After the polishing of the wafer W is completed (see step S203), the dressing unit 50 dresses the polishing surface 2*a* of the polishing pad 2 by the dresser 51. The controller 9 measures the thickness of the polishing pad 2 to measure (i.e., calculate) the amount of wear of the polishing pad 2 (see step S301). The controller 9 corrects film thickness information of the next wafer W to be polished based on the correction data stored in the memory unit 9*a*. With such a correction, the controller 9 can acquire more accurate film thickness information.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table configured to support a polishing pad;

a plurality of film thickness sensors embedded in the polishing table, the film thickness sensors outputting a plurality of signals corresponding to a film thickness of a substrate comprising a notch formed on a peripheral edge portion of the substrate; and a controller configured to measure film thickness information of the substrate based on the signals acquired from the film thickness sensors wherein the film thickness sensors comprise PSD sensors and wherein the PSD sensors emit light to the substrate wherein the signals output from the film thickness sensor comprise a voltage corresponding to an angle of a light reflected from the substrate, wherein when an inner region on the polishing pad in contact with a peripheral edge portion of the substrate is defined as an inner edge portion and an outer region on the polishing pad in contact with the peripheral edge portion of the substrate is defined as an outer edge portion, the film thickness sensors are arranged from the inner edge portion to the outer edge portion at corresponding positions on the polishing table, and wherein the controller is further configured to:

analyze film thickness distribution information of the substrate on the measured film thickness information in relation to a position of the notch on the substrate, and output visualization information of a film thickness distribution with the position of the notch as a reference position, and wherein the position of the notch is determined relative to the film thickness sensors during polishing the substrate and the position of measured film thickness on the substrate is calculated in relation to the notch to the film thickness sensors.

2. The polishing apparatus according to claim 1, wherein the controller comprises a median filter unit configured to perform a median filter on the signals acquired from each of the film thickness sensors, and wherein the median filter unit performs the median filter on the signals acquired from each of the film thickness sensors, and removes noise from the signals.

3. The polishing apparatus according to claim 1, wherein the polishing apparatus comprises a wear amount detection device configured to output a signal corresponding to the amount of wear of the polishing pad, and wherein the controller is configured to:

measure the amount of wear of the polishing pad based on the signal acquired from the wear amount detection device; and correct film thickness information based on the measured the amount of wear of the polishing pad.

4. The polishing apparatus according to claim 1, wherein the polishing apparatus comprises a display device connected to the controller, and wherein the controller is configured to output visualization information of the film thickness distribution to the display device.

5. The polishing apparatus according to claim 1 further comprising:

a polishing head configured to press the substrate against the polishing pad during polishing of the substrate, wherein the controller is further configured to:

determine an angle of a radian on the substrate and a distance on the radian from a center of the substrate to a specific position on the substrate, the angle of the radian determined with respect to a rotation angle of the substrate and a relationship between the rotation angle of the polishing head and the position of the notch, and control a pressing element in the polishing head corresponding to the specific position to control a pressing force with respect to the specific position on the substrate.

6. A polishing apparatus comprising:

a polishing table configured to support a polishing pad;

a plurality of film thickness sensors embedded in the polishing table, the film thickness sensors outputting a plurality of signals corresponding to a film thickness of a substrate; and a controller configured to measure film thickness information of the substrate based on the signals acquired from the film thickness sensors, wherein when an inner region on the polishing pad in contact with a peripheral edge portion of the substrate is defined as an inner edge portion and an outer region on the polishing pad in contact with the peripheral edge portion of the substrate is defined as an outer edge portion on the polishing pad, the film thickness sensors are arranged from the inner edge portion to the outer edge portion at corresponding positions on the polishing table, and wherein the controller is further configured to:

analyze film thickness distribution information of the substrate while identifying a notch position of the based on the measured film thickness information in relation to a position of the notch on the substrate, and output visualization information of a film thickness distribution with the position of the notch position as a reference position, and wherein the position of the notch is determined relative to the film thickness sensors during polishing the substrate and the position of measured film thickness on the substrate is calculated in relation to the notch to the film thickness sensors.

* * * * *